US009153185B2

(12) United States Patent
Yoo et al.

(10) Patent No.: US 9,153,185 B2
(45) Date of Patent: Oct. 6, 2015

(54) FIELD SEQUENTIAL LIQUID CRYSTAL DISPLAY DEVICE AND METHOD OF FABRICATING THE SAME

(75) Inventors: Jang-Jin Yoo, Seoul (KR); Hyeon-Ho Son, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 921 days.

(21) Appl. No.: 10/464,442

(22) Filed: Jun. 19, 2003

(65) Prior Publication Data

US 2004/0036672 A1 Feb. 26, 2004

(30) Foreign Application Priority Data

Aug. 23, 2002 (KR) ..... 10-2002-0050149

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 2310/0235* (2013.01); *G09G 2320/0606* (2013.01); *G09G 2320/0673* (2013.01)

(58) Field of Classification Search
CPC ..... G09G 3/36; G09G 3/3648; G09G 3/3406; G09G 2320/0673; G09G 2310/0235; G09G 2320/0606
USPC ..... 345/30, 84, 87–100, 102, 204
See application file for complete search history.

(56) References Cited

U.S. PATENT DOCUMENTS

| | | | | |
|---|---|---|---|---|
| 6,008,786 | A * | 12/1999 | Kimura et al. | 345/89 |
| 6,459,416 | B1 * | 10/2002 | Sasaki et al. | 345/89 |
| 6,803,893 | B1 * | 10/2004 | Hwang | 345/88 |
| 7,006,065 | B1 * | 2/2006 | Sugawara et al. | 345/89 |
| 2002/0057374 | A1 * | 5/2002 | Suzuki | 348/674 |
| 2002/0149701 | A1 * | 10/2002 | Tagomori et al. | 348/655 |

FOREIGN PATENT DOCUMENTS

| | | |
|---|---|---|
| JP | 09-218668 | 8/1997 |
| JP | 2000-199886 | 7/2000 |

* cited by examiner

*Primary Examiner* — Rodney Amadiz
(74) *Attorney, Agent, or Firm* — Dentons US LLP

(57) ABSTRACT

A field sequential liquid crystal display device includes a circuit unit producing RGB reference voltages and scanning signal voltages using RGB data and control signals, a liquid crystal display panel changing alignment direction of liquid crystal molecules in accordance with the RGB reference voltages and the scanning signal voltages, and a backlight device emitting light to the liquid crystal display panel, wherein the circuit unit includes an interface receiving the RGB data and the control signals, a timing controller generating gate control signals and data control signals, at least two gamma generating units generating the RGB reference voltages, a switch selecting one of the RGB reference voltages, a data driver receiving the data control signal and the selected RGB reference voltage selected from the switch, and supplying an RGB image voltage to the liquid crystal display panel in accordance with the selected RGB reference voltage and the data control signal, and a gate driver receiving the gate control signals from the timing controller and supplying the scanning signal voltage to the liquid crystal display panel in accordance with the gate control signal.

26 Claims, 7 Drawing Sheets

FIELD SEQUENTIAL LIQUID CRYSTAL DISPLAY DEVICE AND METHOD OF FABRICATING THE SAME

The present invention claims the benefit of Korean Patent Application No. 2002-0050149, filed in Korea on Aug. 23, 2002, which is hereby incorporated by reference.

BACKGROUND OF THE INVENTION

1. Field of the Invention

The present invention relates to a display device and a method of fabricating a display device, and more particularly, to a field sequential liquid crystal display device and method of fabricating a field sequential liquid crystal display device.

2. Discussion of the Related Art

Cathode-ray tube (CRT) devices have been commonly used for visual display systems. However, development of flat panel display devices are increasingly being used because of their small depth dimensions, desirably low weight, and low power consumption. Currently, thin film transistor-liquid crystal display (TFT-LCD) devices have been developed having high resolution and small depth dimensions.

In general, a liquid crystal display (LCD) device includes an upper substrate, a lower substrate, and a liquid crystal material layer interposed therebetween. The upper and lower substrates each have electrodes opposing one another. When an electric field is supplied to the electrodes of the upper and lower substrates, molecules of the liquid crystal material layer become aligned according to the applied electric field. By controlling the electric field, the liquid crystal display device provides various light transmittances to display images. Accordingly, an active matrix liquid crystal display (AM-LCD) device commonly used because of its high resolution and superior display of moving images. An active matrix liquid crystal display has a plurality of switching elements and pixel electrodes that are arranged in an array matrix configuration on the lower substrate. Accordingly, the lower substrate of the active matrix liquid crystal display is commonly referred to as an array substrate.

FIG. 1 is a cross sectional view of a liquid crystal display device according to the related art. In FIG. 1, a liquid crystal display includes a liquid crystal panel 10 and a backlight device 60, wherein the liquid crystal panel 10 includes a color filter substrate (i.e., an upper substrate) 20 and an array substrate (i.e., a lower substrate) 30 that face each other across a liquid crystal material layer 50. In addition, the color filter substrate 20 includes a color filter layer 22 and a black matrix 26 formed on a rear surface of a transparent substrate 1. The color filter layer 22 includes one of red (R), green (G), and blue (B) color filters, and the black matrix 26 is disposed among the red (R), green (G) and blue (B) color filters for preventing light leakage. A common electrode 24 is formed on a rear surface of the color filter 22 to function as one of an electrode pair for applying an electric field to the liquid crystal material layer 50.

The lower substrate 30 includes a thin film transistor T, which functions as a switching element, formed on the transparent substrate 1 to face the upper substrate 20. A pixel electrode 34, which is electrically connected to the thin film transistor T and functions as a second one of the electrode pair for applying the electric field to the liquid crystal material layer 50, is formed on the transparent substrate 1 of the array substrate 30. First and second polarizers 25 and 35 are formed on outer surfaces of the transparent substrate 1.

The backlight device 60 is disposed under the array substrate 30 to irradiate light to the liquid crystal panel 10. The back light 60 includes a white light source 62 to emit white light along a direction to the liquid crystal panel 10. Although not shown in FIG. 1, the thin film transistor T includes a gate electrode, a source electrode, and a drain electrode. The liquid crystal display panel 10 supplies a voltage to the pixel electrode 34 via the thin film transistor T, wherein the electric field between the pixel electrode 34 and the common electrode 24 rearranges an alignment direction of the liquid crystal molecules of the liquid crystal material layer 50. The white light emitted by the backlight device 60 is transmitted through the liquid crystal panel 10 having the color filters 22 to display color images. Due to a polarization of white light and optical anisotropy of liquid crystal molecules, the polarized light is modulated by passing through the red (R), green (G), and blue (B) color filters, thereby producing color images.

Although not shown in FIG. 1, the upper and lower substrates 20 and 30 are attached to each other by a seal pattern formed along peripheries of the upper and lower substrates 20 and 30. To align the liquid crystal molecules along a desired direction, upper and lower alignment layers (not shown) are provided between the liquid crystal material layer 50 and the upper substrate 20 and between the liquid crystal layer 50 and the lower substrate 30, respectively.

However, the active matrix liquid crystal display device in FIG. 1 has significant problems. First, since the transmissivity of a material used for forming the color filters is less than 33%, a brighter backlight device is required in order to effectively display the color images. Accordingly, the active matrix liquid crystal display device requires increased power consumption. Second, since the material used for forming the color filters is expensive, manufacturing costs increase. In addition, as a thickness of the color filters increase in order to improve saturation and chromaticity of the displayed color images, the transmissivity of the liquid crystal panel is reduced. On the contrary, if the thickness of the color filters decreases to improve the transmissivity, the displayed color images will have poor degrees of resolution.

As a result, field sequential liquid crystal display (FS LCD) devices, which display full color images without using the color filters, have been developed. The active matrix liquid crystal display devices display the color images by constantly transmitting the white light from the backlight device to the liquid crystal panel, whereas the field sequential liquid crystal display devices display the color images by sequentially and periodically turning ON and OFF the light sources, which have Red (R), Green (G), and Blue (B) colors.

FIG. 2 is a schematic cross sectional view of one pixel region of a field sequential liquid crystal display device according to the related art, and FIG. 3 is a schematic block diagram of a field sequential liquid crystal display device according to the related art. Since the same reference numbers may be used for the same parts in both FIGS. 2 and 3, some explanations may be omitted to prevent duplication.

In FIGS. 2 and 3, the field sequential liquid crystal display device includes a circuit unit 80, a liquid crystal display panel 10, and a backlight device 61. The circuit unit 80 receives RGB data and other control signals from an external driving system 70 (i.e., a computer system) and controls the received data and signals. The liquid crystal display panel 10 displays images by aligning and rearranging liquid crystal molecules, and the backlight device 61 irradiates light to the liquid crystal display panel 10.

In FIG. 2, the liquid crystal display panel 10 includes an upper substrate 20 and a lower substrate 30 that face each other across a liquid crystal material layer 50. The upper substrate 20 includes a black matrix 26 formed on a rear surface of a transparent substrate 1. Unlike the liquid crystal display device of FIG. 1, the color filter layer is not disposed on the upper substrate 20. In addition, a transparent common electrode 24 is formed on the rear surface of the transparent substrate 1 to cover the black matrix 26.

In FIG. 2, the lower substrate 30 includes a thin film transistor T, which functions as a switching element, formed on the transparent substrate 1 to face the upper substrate 20. A pixel electrode 34, which is electrically connected to the thin film transistor T and serves as a first electrode for applying an electric field to the liquid crystal material layer 50, is formed on the transparent substrate 1 of the array substrate 30. First and second polarizers 25 and 35 are formed on outer surfaces of the transparent substrates 1, respectively. In addition, the backlight device 61 includes three light sources Red (R) 64, Green (G) 66, and Blue (B) 68 to irradiate colored light to the liquid crystal display panel 10.

In FIG. 3, the liquid crystal display panel 10 includes a plurality of data lines 36 and gate lines 38 that perpendicularly cross each other to define a plurality of pixel regions P in a matrix configuration. The plurality of data lines 36 are formed in parallel to one another and the plurality of gate lines 38 are formed in parallel to one another, wherein both the data and gate lines 36 and 38 are disposed between the upper and lower substrates 20 and 30. Within each of the pixel regions P, the thin film transistor T is disposed as a switching element, and a liquid crystal capacitor $C_{LC}$ and a storage capacitor $C_{ST}$ are disposed within each of the pixel regions P. The pixel electrode 34 and the common electrode 24 constitute the liquid crystal capacitor $C_{LC}$, and the storage capacitor $C_{ST}$ is connected in parallel with the liquid crystal capacitor $C_{LC}$ in order to solve parasitic capacitor problems.

One of the most significant differences between the field sequential liquid crystal display devices of FIGS. 2 and 3 and the liquid crystal display of FIG. 1 is that the field sequential liquid crystal display devices does not require the color filters in the upper substrate 20 and the backlight device 61 including three different light sources 64, 66, and 68 that are sequentially and selectively turned ON and/or OFF. The three different light sources 64, 66, and 68 are each driven by an inverter (not shown) and each are sequentially turned ON and OFF in one frame of one-sixtieth (1/60) of a second. In the field sequential liquid crystal display device, one frame of 1/60 of a second is divided into three sub-frames each being one-hundred-eightieth of a second (1/180 second) of a period. During each sub-frame, the liquid crystal molecules of the liquid crystal material layer 50 are rearranged, and then one of the light sources 64, 66, and 68 is turned ON and OFF. Thus, during one frame, the rearrangement of the liquid crystal molecules and the enablement of one of the red, green, and blue light sources are sequentially repeated.

In FIG. 3, the circuit unit 80 includes an interface 82, a timing controller 84, a gamma generating unit 86, a data driver 88, and a gate driver 90, wherein the circuit unit 80 controls and changes the RGB data and other control signals originating from the driving system 70 into desired signals in order to enable the liquid crystal panel display 10 to display the color images. The interface 82 directly receives the RGB data and other control signals from the driving system 70, and delivers the data and signals to the timing controller 84.

The control signals include a plurality of timing synchronization signals such that the timing controller 84 receiving the timing synchronization signals generates data control signals and gate control signals, respectively. Thus, the data control signals are supplied to the data driver 88 for driving the data driver 88, and the gate control signals are supplied to the gate driver 90 for driving the gate driver 90.

In addition, the timing controller 84 transmits the RGB data received from the interface 82 to the data driver 88. The gamma generating unit 86 generates an RGB reference voltage using the RGB data and transmits the RGB reference voltage to the data driver 88. Accordingly, the RGB reference voltage is set by the intrinsic transmissivity-voltage characteristics of the liquid crystal display panel 10.

The data driver 88 supplies an RGB image voltage, which controls the alignment direction of the liquid crystal molecules, to each of the data lines 36 using the RGB reference voltage transmitted from the gamma generating unit 86. The gate driver 90 supplies a scanning signal voltage, which turns the thin film transistor T ON and OFF, to each of the gate lines 38 using the gate control signals. When the thin film transistor T of a selected pixel region P is turned ON, the RGB image voltage is transmitted to the liquid crystal capacitor $C_{LC}$.

If the R, G, and B light sources 64, 66, and 68 are sequentially turned ON and OFF in an order of R-G-B, the interface 82 receives the R data and its control signal from the driving system 70 during the first sub-frame. Those R data and control signal are transmitted to the timing controller 84 and inverted to the data and gate control signals for driving the data and gate drivers 88 and 90. Then, the gamma generating unit 86 outputs the R reference voltage using the R data, and the data driver 88 supplies the R image voltage to all of the data lines 36. Accordingly, the gate driver 90 outputs the scanning signal voltage sequentially from the G1 gate line to the Gm gate line using the gate control signals, thereby rearranging the direction of the liquid crystal molecules of the liquid crystal material layer 50 within the selected pixel regions P. The rearrangement of the selected pixel regions P corresponding the G1 gate line is maintained until the liquid crystal molecules of the pixel regions P corresponding to the Gm gate line are rearranged. After supplying the scanning signal voltage to all of the gate lines 38, the R light source 64 is turned ON to display the red (R) color image.

Accordingly, the second sub-frame handles the G data and its control signal through the above sequence, thereby displaying the G color image like the first sub-frame. The third sub-frame also handles the B data and its control signal, and thus displays the B color image. Accordingly, one frame is complete by way of sequentially conducting the first to third sub-frames.

Each of first to third sub-frames takes 1/180 seconds, and thus the single frame takes 1/60 seconds. Accordingly, a color image caused by the combination of three colors (red, green, and blue) is displayed using an afterimage (i.e., residual image) effect of human vision. Although the Red (R), Green (G), and Blue (B) light sources are turned ON and OFF one-hundred and eighty times per second, the perception by the naked eye is that the light sources are constantly ON due to the afterimage (or residual image) effect. For example, if the Red light source is turned ON and the Blue light source is sequentially turned ON, a mixed color (i.e., violet) is shown due to the residual image effect. Furthermore, if all of the R, G, and B color images show the lowest transmissivity, the human eye perceives a black color.

FIG. 4 is a graph illustrating a relationship between transmissivity and applied voltage in a field sequential liquid crystal display device using Optical Compensated Birefringent (OCB) mode according to the related art, and FIG. 5 is an enlarged view of portion A of the graph in FIG. 4 according to the related art. In FIGS. 4 and 5, transmissivity differences are noticeable depending on the R, G, and B colors although the same reference voltage is applied. In FIG. 5, since the R, G, and B colors have different wavelengths, the R, G, and B colors have different lowest transmissivities such that the combination will produce the black color. In particular, the B color wavelength arrives to the lowest transmissivity earlier than the R and G color wavelengths, and the B color wavelength has a relatively large transmissivity as compared to the R and G colors around the voltage necessary to produce the black color. In addition, the B color wavelength is generated during displaying the black color, thereby producing the blue shift phenomenon. Not only in the OCB mode but in the other modes, the transmissivity difference appears under the same voltage in the OCB mode and in other modes, and a color shift may be generated that degrades the image quality of the liquid crystal display.

SUMMARY OF THE INVENTION

Accordingly, the present invention is directed to a field sequential liquid crystal display (FS LCD) device and a method of fabricating a field sequential liquid crystal display (FS LCD) device that substantially obviates one or more of problems due to limitations and disadvantages of the related art.

An object of the present invention is to provide a field sequential liquid crystal display device that maintains uniform transmissivity of red (R), green (G), and blue (B) color wavelengths.

Another object of the present invention is to provide a method of fabricating a field sequential liquid crystal display device that maintains uniform transmissivity of red (R), green (G), and blue (B) color wavelengths.

Additional features and advantages of the invention will be set forth in the description which follows and in part will be apparent from the description, or may be learned by practice of the inventions. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a field sequential liquid crystal display device includes a circuit unit producing RGB reference voltages and scanning signal voltages using RGB data and control signals transmitted from an external driving system, a liquid crystal display panel changing alignment direction of liquid crystal molecules in accordance with the RGB reference voltages and the scanning signal voltages, and a backlight device emitting light to the liquid crystal display panel, wherein the circuit unit includes an interface receiving the RGB data and the control signals from the external driving system, a timing controller generating gate control signals and data control signals in accordance with the RGB data and the control signals, at least two gamma generating units generating the RGB reference voltages having different values in accordance with the RGB data, a switch selecting one of the RGB reference voltages, a data driver receiving the data control signal from the timing controller and the selected RGB reference voltage selected from the switch, and supplying an RGB image voltage to the liquid crystal display panel in accordance with the selected RGB reference voltage and the data control signal, and a gate driver receiving the gate control signals from the timing controller and supplying the scanning signal voltage to the liquid crystal display panel in accordance with the gate control signal.

In another aspect, a method of fabricating a field sequential liquid crystal display device includes providing a circuit unit for producing RGB reference voltages and scanning signal voltages using RGB data and control signals transmitted from an external driving system, providing a liquid crystal display panel for changing alignment direction of liquid crystal molecules in accordance with the RGB reference voltages and the scanning signal voltages, and providing a backlight device for emitting light to the liquid crystal display panel, wherein the circuit unit includes an interface receiving the RGB data and the control signals from the external driving system, a timing controller generating gate control signals and data control signals in accordance with the RGB data and the control signals, at least two gamma generating units generating the RGB reference voltages having different values in accordance with the RGB data, a switch selecting one of the RGB reference voltages, a data driver receiving the data control signal from the timing controller and the selected RGB reference voltage selected from the switch, and supplying an RGB image voltage to the liquid crystal display panel in accordance with the selected RGB reference voltage and the data control signal, and a gate driver receiving the gate control signals from the timing controller and supplying the scanning signal voltage to the liquid crystal display panel in accordance with the gate control signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiment of the present invention, which is illustrated in the accompanying drawings.

Figure 1:
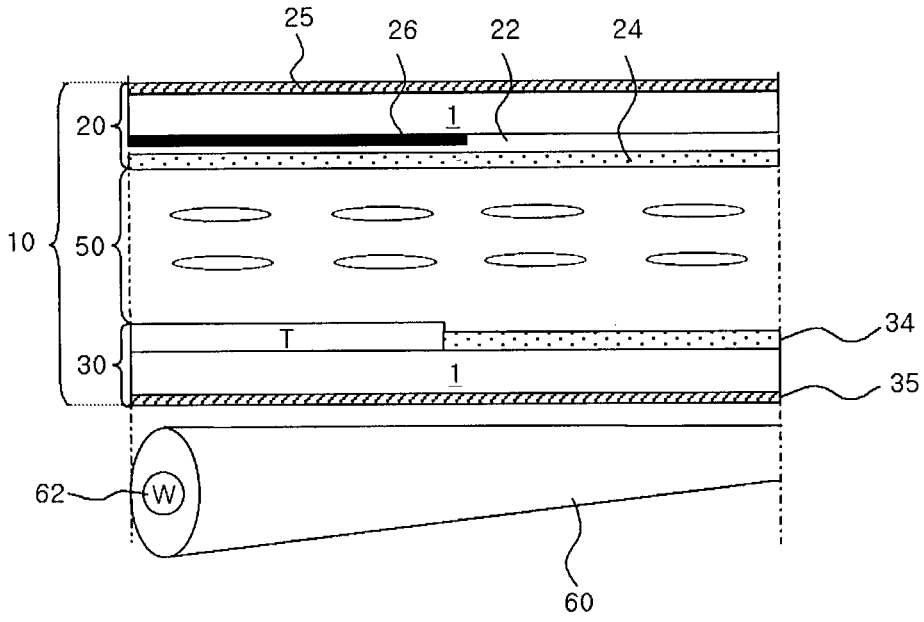
FIG. 1 RELATED ART
FIG. 1 is a cross sectional view of a liquid crystal display device according to the related art.
Figure 2:
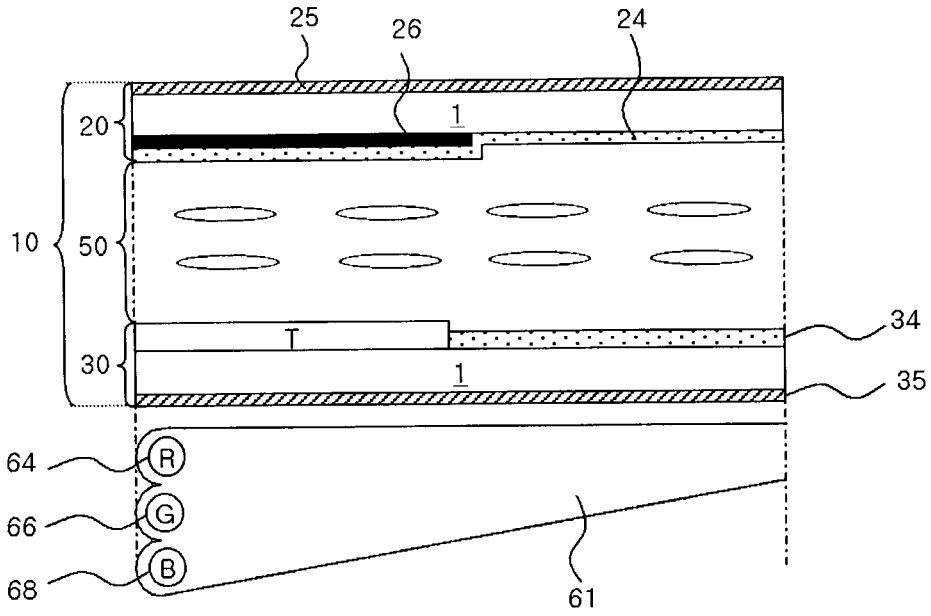
FIG. 2 RELATED ART
FIG. 2 is a schematic cross sectional view of one pixel region of a field sequential liquid crystal display device according to the related art.
Figure 3:
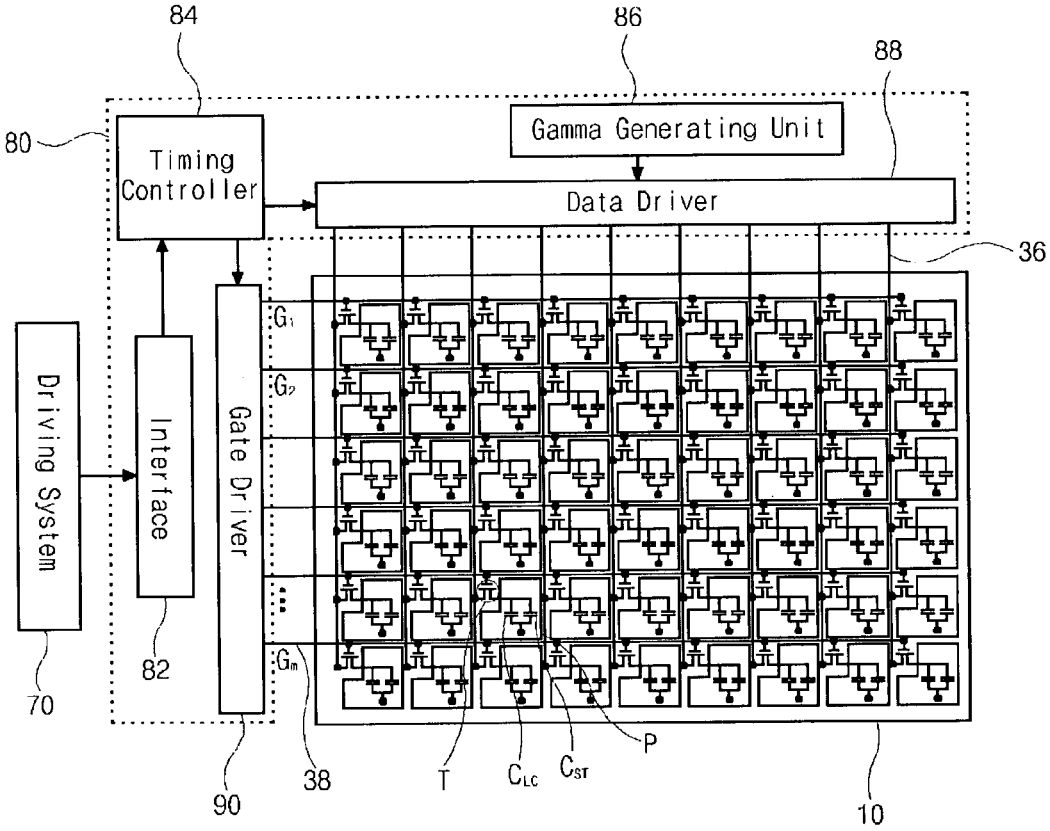
FIG. 3 RELATED ART
FIG. 3 is a schematic block diagram of a field sequential liquid crystal display device according to the related art.
Figure 4:
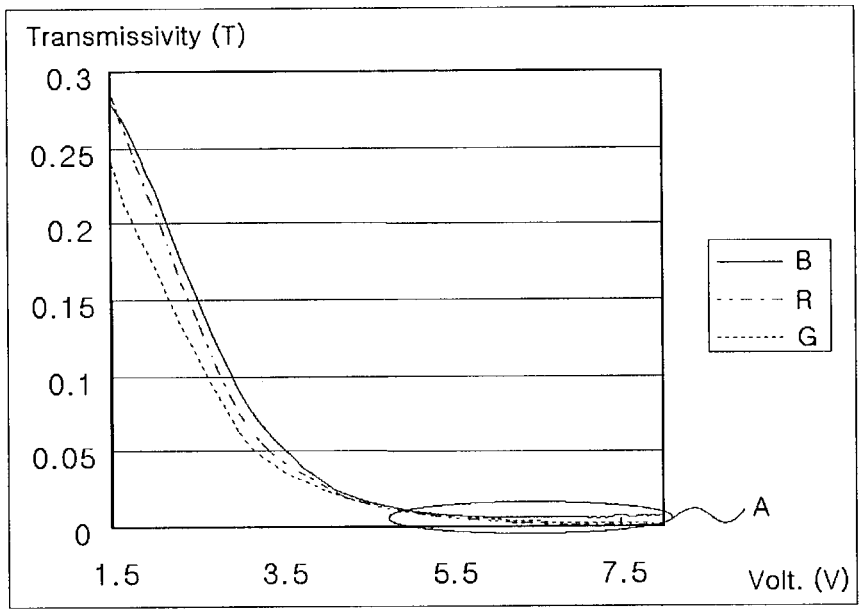
FIG. 4 RELATED ART
FIG. 4 is a graph illustrating a relationship between transmissivity and applied voltage in a field sequential liquid crystal display device using Optical Compensated Birefringent (OCB) mode according to the related art.
Figure 5:
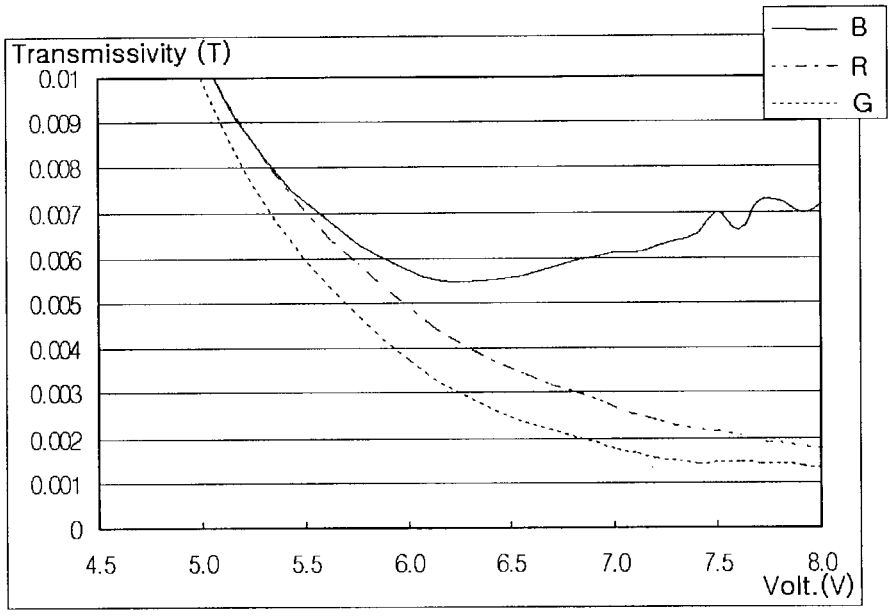
FIG. 5 RELATED ART
FIG. 5 is an enlarged view of portion A of the graph in FIG. 4 according to the related art.
Figure 6:
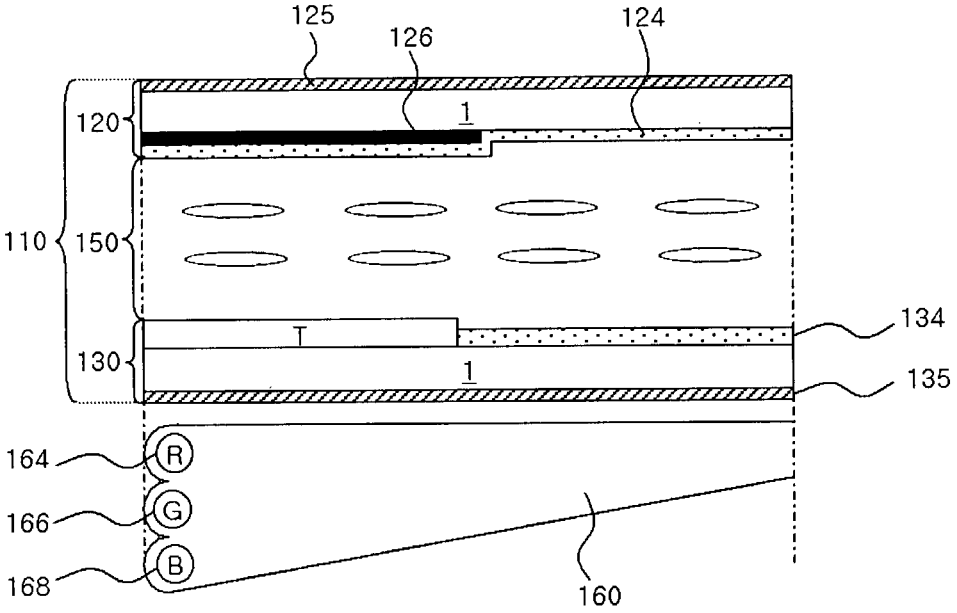
FIG. 6 is a schematic cross sectional view of an exemplary field sequential liquid crystal display device according to the present invention.
Figure 7:
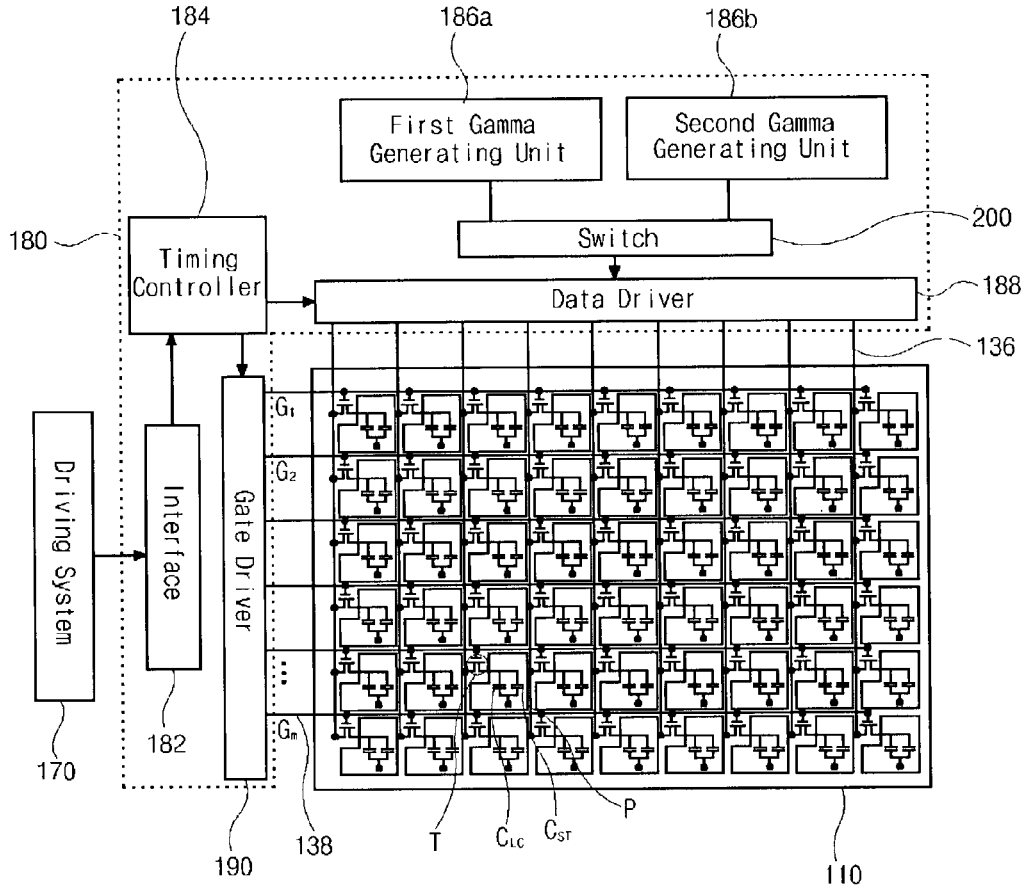
FIG. 7 is a schematic block diagram of another exemplary field sequential liquid crystal display device according to the present invention.

FIG. 6 is a schematic cross sectional view of an exemplary field sequential liquid crystal display device according to the present invention, and FIG. 7 is a schematic block diagram of another exemplary field sequential liquid crystal display device according to the present invention. In FIGS. 6 and 7, a field sequential liquid crystal display device may include a circuit unit 180, a liquid crystal display panel 110, and a backlight device 160. The circuit unit 180 may receive RGB data and a plurality of control signals from an external driving system 170, such as a computer system, and may control the received data and signals. The liquid crystal display panel 110 may display images by aligning and rearranging liquid crystal molecules of a liquid crystal material layer 150, wherein the backlight device 160 may be disposed under the liquid crystal display panel 110 to irradiate light onto the liquid crystal display panel 110.

In FIG. 6, the liquid crystal display panel 110 may include an upper substrate 120 and a lower substrate 130 and a liquid crystal material layer 150 disposed therebetween. The upper substrate 120 may include a black matrix 126 formed on a rear surface of a transparent substrate, and a transparent common electrode 124 may be formed on the rear surface of the transparent substrate 1 to cover the black matrix 126.

The lower substrate 130 may include a thin film transistor T, which may function as a switching element, formed on the transparent substrate 1 facing the upper substrate 120. A pixel electrode 134, which may be electrically connected to the thin film transistor T and may serve as an electrode for applying an electric field to the liquid crystal material layer 150, may be formed on the transparent substrate 1 of the array substrate 130. In addition, first and second polarizers 125 and 135 may be formed on the outer surfaces of the transparent substrates 1, respectively, and the backlight device 160 may include three light sources Red (R) 164, Green (G) 166, and Blue (B) 168 to irradiate colored light onto the liquid crystal display panel 110.

Although not shown in FIG. 6, the upper and lower substrates 120 and 130 may be attached to each other by a seal pattern disposed along peripheries of the upper and lower substrates 120 and 130. To align the liquid crystal molecules along a desired direction, upper and lower alignment layers (not shown) may be disposed between the liquid crystal material layer 150 and the upper substrate 120 and between the liquid crystal material layer 150 and the lower substrate 130, respectively.

In FIG. 7, the liquid crystal display panel 110 may include a plurality of data lines 136 and gate lines 138 that perpendicularly cross each other to define a plurality of pixel regions P that may be arranged in a matrix configuration. The plurality of data lines 136 may be formed in parallel to one another, and the plurality of gate lines 138 may be formed in parallel to one another, wherein both the data and gate lines 136 and 138 may be disposed between the upper and lower substrates 120 and 130. The thin film transistor T may be disposed within each of the pixel regions P to function as a switching element, and a liquid crystal capacitor $C_{LC}$ and a storage capacitor $C_{ST}$ may also be disposed within each of the pixel regions P. The pixel electrode 134 and the common electrode 124 may constitute the liquid crystal capacitor $C_{LC}$, and the storage capacitor $C_{ST}$ may be connected in parallel with the liquid crystal capacitor $C_{LC}$ in order to solve parasitic capacitor problems.

In the field sequential liquid crystal display devices of FIGS. 6 and 7 color filters may not be necessary in the liquid crystal display panel 110. In addition, the field sequential liquid crystal display devices may include a backlight device 160 that has three different light sources 164, 166, and 168 that are sequentially and selectively turned ON and/or OFF. The light sources include Red (R) 164, Green (G) 166, and Blue (B) 168 colors and may each be driven by an inverter (not shown). Accordingly, each of the Red, Green and Blue light sources 164, 166, and 168 may be sequentially turned ON and OFF, wherein one frame may last one-sixtieth (1/60) of a second. Thus, the field sequential liquid crystal display device may have one frame of 1/60 of a second divided into three sub-frames each one being one-hundred-eightieth of a second (1/180 second) long. During each sub-frame, the liquid crystal molecules of the liquid crystal material layer 150 may be rearranged, and one of the Red, Green, and Blue light sources 164, 166 and 168 may be turned ON and OFF. Therefore, during one frame, the rearrangement of the liquid crystal molecules and the enabling of one of the Red, Green, and Blue light sources may be sequentially repeated.

In FIG. 7, the circuit unit 180 may include an interface 182, a timing controller 184, a data driver 188, and a gate driver 190. The circuit unit 180 may further include a switch 200 and at least two gamma generating units 186. Accordingly, the circuit unit 180 may control and change the RGB data and the plurality of control signals originating from the driving system 170 into desired signals in order to cause the liquid crystal display panel 110 to properly display the color images. A first gamma generating unit 186*a* and a second gamma generating unit 186*b* may create different R, G and B reference voltages. The R, G and B reference voltages may be referred to as RGB reference voltage. The switch 200 may be connected to the first and second gamma generating units 186*a* and 186*b*, and may select one of the first and second gamma generating units 186*a* and 186*b* to supply selected reference voltages to the data driver 188.

The interface 182 may directly receive the RGB data and the plurality of control signals from the driving system 170, and may deliver the data and signals to the timing controller 184. The control signals may include a plurality of timing synchronization signals, wherein the timing controller 184 receiving the timing synchronization signals may generate data control signals and gate control signals, respectively. Thus, the data control signals may be supplied to the data driver 188 for driving the data driver 188, and the gate control signals may be supplied to the gate driver 190 for driving the gate driver 190. Furthermore, the timing controller 184 may transmit the RGB data received from the interface 182 to the data driver 188.

The first and second gamma generating units 186*a* and 186*b* may generate the different RGB reference voltages, respectively, and transmit the different RGB reference voltages to the switch 200. Then, the switch 200 may select one of the RGB reference voltages and may deliver the selected RGB reference voltage to the data driver 188. Accordingly, the RGB reference voltage may be selected by the user based upon the desired wavelength of colors displayed in the liquid crystal display device. In order to overcome transmissivity differences under the same reference voltages, the plural gamma generating units 186 may produce the different values of RGB reference voltage, and the switch 200 may select an appropriate reference voltage among those RGB reference voltages and may transmit the selected RGB reference voltage to the data driver 188.

The data driver 188 may supply an RGB image voltage, which controls the alignment direction of the liquid crystal molecules, to each of the data lines 136 using both the RGB reference voltage transmitted from the switch 200 and the data control signals transmitted from the timing controller 184. The gate driver 190 may sequentially scan a scanning signal voltage, which turns the thin film transistor T ON and OFF, to each of the gate lines 138 using the gate control signals. When the thin film transistor T of the selected pixel region P is turned ON, the RGB image voltage is transmitted to the liquid crystal capacitor $C_{LC}$.

Meanwhile, an Optically Compensated Birefringent (OCB) liquid crystal material may be used because the OCB liquid crystal has a faster response speed than Twisted Nematic (TN) liquid crystal material and Super Twisted Nematic (STN) liquid crystal material. Accordingly, when the OCB liquid crystal material is used to show a desired color, although the same reference voltage may be supplied, the R, G, and B colors may have different transmissivities. For example, the lowest transmissivity of B color differs from the transmissivities of R and G colors, thereby producing the blue shift when the black color is displayed. To overcome this problem, the first gamma generating unit 186*a* may generate a first RGB reference voltage considering the intrinsic transmissivity-voltage characteristics of the liquid crystal display panel 110. Then, the second gamma generating unit 186*b* may generate a second RGB reference voltage to produce the lowest transmissivity of B color when the black color is displayed when the RG reference voltage causes the R and G colors to have the lowest transmissivity. Further, the RGB reference voltages generated by the first and second gamma generating units 186*a* and 186*b* may be selected by the switch 200 and may be transmitted to the data driver 188. For example, the switch 200 delivers the RG reference voltages of the first gamma generating unit 186*a* to the data driver 188 during the first and second sub-frames, respectively, and then delivers the B reference voltage of the second gamma generating unit 186*b* to the data driver 188 during the third sub-frame. Therefore, the blue shift phenomenon may be prevented when the black color is displayed, and the desired color having good quality can be obtained.

Accordingly, if the R, G, and B light sources 164, 166, and 168 are turned ON and OFF in a sequential order of R-G-B, the interface 182 receives the R data and its control signal from the driving system 170 during the first sub-frame. The R data and control signal are transmitted to the timing controller 184 and then inverted into the data and gate control signals for driving the data and gate drivers 188 and 190. Then, the first and second gamma generating units 186*a* and 186*b* output the first and second R reference voltages, respectively, which each have different values, and the switch 200 selects one of the first and second R reference voltages and delivers the selected R reference voltage to the data driver 188. Therefore, the data driver 188 supplies an R image voltage to all of the data lines 136. At this time, the gate driver 190 outputs the scanning signal voltage sequentially from the G1 gate line to the Gm gate line using the gate control signals, thereby rearranging the direction of the liquid crystal molecules of the liquid crystal material layer 150. The rearrangement of the pixel regions P of the G1 gate line is maintained until the liquid crystal molecules of the pixel regions P of the Gm gate line are rearranged. Simultaneously with supplying the scanning signal voltage to all of the gate lines 138, the R light source 164 is turned ON to display the red (R) color image.

Furthermore, during the second sub-frame, the interface 182 receives the G data and its control signal from the driving system 170. The G data and control signal are transmitted to the timing controller 184 and then inverted into the data and gate control signals for driving the data and gate drivers 188 and 190. Then, the first and second gamma generating units 186*a* and 186*b* output the first and second G reference voltages, respectively, which have different values, and the switch 200 selects one of the first and second G reference voltages and delivers the selected G reference voltage to the data driver 188. Therefore, the data driver 188 supplies a G image voltage to all of the data lines 136. Accordingly, the gate driver 190 outputs the scanning signal voltage sequentially from the G1 gate line to the Gm gate line using the gate control signals, thereby rearranging the direction of the liquid crystal molecules of the liquid crystal material layer 150. The rearrangement of the pixel regions P of the G1 gate line may be maintained until the liquid crystal molecules of the pixel regions P of the Gm gate line are rearranged. Simultaneously with supplying the scanning signal voltage to all of the gate lines 138, the G light source 166 is turned ON to display the green (G) color image.

During the third sub-frame, the interface 182 receives the B data and its control signal from the driving system 170. The B data and control signal are transmitted to the timing controller 184 and then inverted to the data and gate control signals for driving the data and gate drivers 188 and 190. Then, the first and second gamma generating units 186*a* and 186*b* output the first and second B reference voltages, respectively, which have different values, and the switch 200 selects one of the first and second B reference voltages and delivers the selected B reference voltage to the data driver 188. Therefore, the data driver 188 supplies a B image voltage to all of the data lines 136. Accordingly, the gate driver 190 outputs the scanning signal voltage sequentially from the G1 gate line to the Gm gate line using the gate control signals, thereby rearranging the direction of the liquid crystal molecules of the liquid crystal material layer 150. The rearrangement of the pixel regions P of the G1 gate line may be maintained until the liquid crystal molecules of the pixel regions P of the Gm gate line are rearranged. Simultaneously, with supplying the scanning signal voltage to all of the gate lines 138, the B light source 168 is turned ON to display the blue (B) color image.

Accordingly, one frame is complete by way of sequentially conducting the above-mentioned first to third sub-frames. The RGB reference voltages generated from the first and second gamma generating units 186*a* and 186*b* overcome the transmissivity differences of the colors. Each of first to third sub-frames takes about 1/180 seconds, and thus the single frame takes about 1/60 seconds. Therefore, a color image caused by the combination of three colors (red, green, and blue) is displayed using an afterimage (i.e., residual image) effect of human vision. Although the Red (R), Green (G), and Blue (B) light sources are turned ON and OFF about one-hundred-eighty times per second, the perception by the naked eye is that the light sources are kept ON due to the afterimage (or residual image) effect.

Although the present invention discloses two gamma generating units, it is possible that more than two gamma generating units may be provided in the circuit unit. Accordingly, the additional two gamma generating units may generate different RGB reference voltages and then the switch selects and delivers one of the RGB reference voltages to the data driver. Furthermore, the principle of the present invention can be adopted not only in field sequential liquid crystal display devices but also in general liquid crystal display devices. Since the present invention includes at least two gamma generating units producing different reference voltages and the switch selecting the proper reference voltage, the transmissivity of the desired color may increase. For example, each sub-frame may select the proper reference voltage from one of at least two gamma generating units. Accordingly, when the OCB liquid crystal material is operating in a black mode, the blue shift may be prevented.

It will be apparent to those skilled in the art that various modifications and variations can be made in the field sequential liquid crystal display device and the method of fabricating a field sequential liquid crystal display device of the present invention without departing from the spirit or scope of the invention. Thus, it is intended that the present invention cover the modifications and variations of this invention provided they come within the scope of the appended claims and their equivalents.

What is claimed is:

1. A field sequential liquid crystal display device, comprising:

a circuit unit for producing R, G, and B reference voltages and scanning signal voltages using R, G, and B data and control signals transmitted from an external driving system;

a liquid crystal display panel for changing alignment direction of liquid crystal molecules in accordance with R, G, and B image voltages and the scanning signal voltages, wherein the R, G, and B image voltages are supplied to the liquid crystal panel during R, G, and B sub-frames, respectively, of each frame; and a backlight device for emitting light to the liquid crystal display panel, wherein the circuit unit includes:

an interface for receiving the R, G, and B data and the control signals from the external driving system;

a timing controller for generating gate control signals and data control signals in accordance with the R, G, and B data and the control signals;

a plurality of gamma generating units, in parallel with each other, each gamma generating unit for generating one each of a R, G, and B reference voltage, wherein the R, G, and B reference voltages from each of the plurality of gamma generating units are different values respectively, including a first gamma generating unit for generating R, G, and B reference voltages considering intrinsic transmissivity-voltage characteristics of the liquid crystal display panel and a second gamma generating unit for generating R, G, and B reference voltages to produce a lowest transmissivity of a blue color when a black color is displayed on the liquid crystal display panel;

a switch for selecting one of the R reference voltages in a first sub-frame after the plurality of gamma generating units outputs the R reference voltages, one of the G reference voltages in a second sub-frame after the plurality of gamma generating units outputs the G reference voltages, and one of the B reference voltages in a third sub-frame after the plurality of gamma generating units outputs the B reference voltages, wherein the switch selects from any of the generated R, G, and B reference voltages and supplies the selected reference voltages directly to a data driver during the R, G, and B sub-frames respectively;

the data driver for receiving the data control signal and the R, G, and B data from the timing controller and the selected R, G, and B reference voltages selected from the switch, for generating the R, G and B image voltages corresponding to the R, G, and B data using the selected R, G, and B reference voltages, respectively, and the data control signal, and for supplying the generated R, G and B image voltages during the R, G, and B sub-frames respectively, to the liquid crystal display panel; and a gate driver for receiving the gate control signals from the timing controller and supplying the scanning signal voltage to the liquid crystal display panel in accordance with the gate control signal.

2. The device according to claim 1, wherein the backlight device includes first, second, and third light sources.

3. The device according to claim 2, wherein each of the first, the second, and the third light sources has one color of red, green, and blue.

4. The device according to claim 1, wherein the first gamma generating unit of the plurality of generating units sequentially generates first R, G, and B reference voltages, in each frame, and the second gamma generating unit of the plurality of generating units sequentially generates second R, G, and B reference voltages.

5. The device according to claim 4, wherein within one frame the data driver sequentially outputs a R image voltage in accordance with the R reference voltage selected by the switch, a G image voltage in accordance with the G reference voltage selected by the switch, and a B image voltage in accordance with the B reference voltage selected by the switch.

6. The device according to claim 5, wherein within each frame the gate driver simultaneously outputs a R scanning signal voltage corresponding to the R image voltage, a G scanning signal voltage corresponding to the G image voltage, and a B scanning voltage corresponding to the B image voltage.

7. The device according to claim 6, wherein within each frame the backlight device sequentially turns ON and OFF a R light source after supplying the R scanning signal voltage to the liquid crystal display panel, a G light source after supplying the G scanning signal voltage to the liquid crystal display panel, and a B light source after supplying the B scanning signal voltage to the liquid crystal display panel.

8. The device according to claim 7, wherein the second B reference voltage of the second gamma generating unit produces the lowest transmissivity of blue color at a time when the first R and G reference voltages of the first gamma generating unit produce a lowest transmissivity of red and green colors.

9. The device according to claim 8, wherein each frame lasts about 1/60 of a second, and includes the R, G and B sub-frames each lasting about 1/180 of a second.

10. The device according to claim 9, wherein in each frame, the R sub-frame lasting about 1/180 of a second includes supplying the R image voltage and the R scanning signal voltage, and then turning ON and OFF the R light source.

11. The device according to claim 9, wherein in each frame, the G sub-frame lasting about 1/180 of a second includes supplying the G image voltage and the G scanning signal voltage, and then turning ON and OFF the G light source.

12. The device according to claim 9, wherein in each frame, the B sub-frame lasting about 1/180 of a second includes applying the B image voltage and the B scanning signal voltage, and then turning ON and OFF the B light source.

13. The device according to claim 1, wherein the liquid crystal molecules include Optical Compensated Birefringent mode liquid crystals.

14. A method of fabricating a field sequential liquid crystal display device, comprising:

providing a circuit unit for producing R, G, and B reference voltages and scanning signal voltages using R, G, and B data and control signals transmitted from an external driving system;

providing a liquid crystal display panel for changing alignment direction of liquid crystal molecules in accordance with R, G, and B image voltages and the scanning signal voltages, wherein the R, G, and B image voltages are supplied to the liquid crystal panel during R, G and B sub-frames, respectively, of each frame; and providing a backlight device for emitting light to the liquid crystal display panel, wherein the circuit unit includes:

an interface for receiving the R, G, and B data and the control signals from the external driving system;

a timing controller for generating gate control signals and data control signals in accordance with the R, G and B data and the control signals;

a plurality of gamma generating units, in parallel with each other, each gamma generating unit for generating one each of a R, G, and B reference voltage, wherein the R, G, and B reference voltages from each of the plurality of gamma generating units are different values respectively, including a first gamma generating unit for generating R, G, and B reference voltages considering intrinsic transmissivity-voltage characteristics of the liquid crystal display panel and a second gamma generating unit for generating R, G, and B reference voltages to produce a lowest transmissivity of a blue color when a black color is displayed on the liquid crystal display panel;

a switch for selecting one of the R reference voltages in a first sub-frame after the plurality of gamma generating units outputs the R reference voltages, one of the G reference voltages in a second sub-frame after the plurality of gamma generating units outputs the G reference voltages, and one of the B reference voltages in a third sub-frame after the plurality of gamma generating units outputs the B reference voltages, wherein the switch selects from any of the generated R, G, and B reference voltages and supplies the selected reference voltages directly to a data driver during the R, G, and B sub-frames respectively;

the data driver for receiving the data control signal and the R, G, and B data from the timing controller and the selected R, G, and B reference voltages selected from the switch, generating the R, G and B image voltages corresponding to the R, G, and B data using the selected R, G, and B reference voltages, respectively, and the data control signal, and for supplying the generated R, G, and B image voltages during the R, G, and B sub-frames respectively, to the liquid crystal display panel; and a gate driver for receiving the gate control signals from the timing controller and supplying the scanning signal voltage to the liquid crystal display panel in accordance with the gate control signal.

15. The method according to claim 14, wherein providing the backlight device includes providing first, second, and third light sources.

16. The method according to claim 15, wherein each of the first, the second, and the third light sources has one color of red, green, and blue.

17. The method according to claim 14, wherein the first gamma generating unit of the plurality of generating units sequentially generates first R, G, and B reference voltages, in each frame, and the second gamma generating unit of the plurality of generating units sequentially generates second R, G, and B reference voltages.

18. The method according to claim 17, wherein within one frame the data driver sequentially outputs a R image voltage in accordance with the R reference voltage selected by the switch, a G image voltage in accordance with the G reference voltage selected by the switch, and a B image voltage in accordance with the B reference voltage selected by the switch.

19. The method according to claim 18, wherein within each frame the gate driver simultaneously outputs a R scanning signal voltage corresponding to the R image voltage, a G scanning signal voltage corresponding to the G image voltage, and a B scanning voltage corresponding to the B image voltage.

20. The method according to claim 19, wherein within each frame the backlight device sequentially turns ON and OFF a R light source after supplying the R scanning signal voltage to the liquid crystal display panel, a G light source after supplying the G scanning signal voltage to the liquid crystal display panel, and a B light source after supplying the B scanning signal voltage to the liquid crystal display panel.

21. The method according to claim 20, wherein the second B reference voltage of the second gamma generating unit produces the lowest transmissivity of blue color at a time when the first R and G reference voltages of the first gamma generating unit produce a lowest transmissivity of red and green colors.

22. The method according to claim 21, wherein each frame lasts about 1/60 of a second, and includes the R, G, and B sub-frames each lasting about 1/180 of a second.

23. The method according to claim 22, further including during the R sub-frame lasting about 1/180 of a second supplying the R image voltage and the R scanning signal voltage, and then turning ON and OFF the R light source.

24. The method according to claim 22, further including during the G sub-frame lasting about 1/180 of a second supplying the G image voltage and the G scanning signal voltage, and then turning ON and OFF the G light source.

25. The method according to claim 22, wherein further including during the B sub-frame lasting about 1/180 of a second applying the B image voltage and the B scanning signal voltage, and then turning ON and OFF the B light source.

26. The method according to claim 14, wherein the liquid crystal molecules include Optical Compensated Birefringent mode liquid crystals.

* * * * *